US006405669B2

(12) United States Patent
Rheault et al.

(10) Patent No.: US 6,405,669 B2
(45) Date of Patent: Jun. 18, 2002

(54) WATERCRAFT WITH STEER-RESPONSE ENGINE SPEED CONTROLLER

(75) Inventors: Alain Rheault, St. Nicolas; Camille Michel, Ste-Foy, both of (CA)

(73) Assignee: Bombardier Inc., Montreal (CA)

( * ) Notice: Subject to any disclaimer, the term of this patent is extended or adjusted under 35 U.S.C. 154(b) by 0 days.

(21) Appl. No.: 09/904,742

(22) Filed: Jul. 16, 2001

Related U.S. Application Data

(63) Continuation of application No. 08/782,490, filed on Jan. 10, 1997, now abandoned.

(51) Int. Cl.[7] ..... B63H 25/00

(52) U.S. Cl. ..... 114/144 R; 440/1; 440/84; 440/87

(58) Field of Search ..... 441/1, 2, 84, 85, 441/86, 87, 900; 114/144 R

(56) References Cited

U.S. PATENT DOCUMENTS

| | | | | |
|---|---|---|---|---|
| 3,183,879 A | | 5/1965 | Heidner | |
| 3,874,321 A | | 4/1975 | Smith | |
| 3,976,026 A | | 8/1976 | Eastling | |
| 4,230,646 A | | 10/1980 | Ghizzoni | 440/84 |
| 4,519,335 A | | 5/1985 | Krautkremer et al. | |
| 4,693,689 A | | 9/1987 | Harada | |
| 4,739,236 A | | 4/1988 | Burkenpas | 318/588 |
| 4,747,359 A | | 5/1988 | Ueno | |
| 4,759,731 A | | 7/1988 | Uchida et al. | |
| 4,767,363 A | | 8/1988 | Uchida et al. | |
| 4,854,902 A | | 8/1989 | Havins | 440/7 |
| 4,962,717 A | | 10/1990 | Tsumiyama | 114/144 R |
| 5,016,553 A | | 5/1991 | Spencer | 114/151 |
| 5,090,929 A | | 2/1992 | Rieben | 440/40 |
| 5,203,727 A | * | 4/1993 | Fukui | 114/122 |
| 5,253,604 A | | 10/1993 | Bohlin | 144/144 E |
| 5,256,092 A | | 10/1993 | Jones | 440/87 |
| 5,368,510 A | | 11/1994 | Richard | 440/84 |
| 5,389,016 A | | 2/1995 | Nestvall | |
| 5,423,277 A | | 6/1995 | Gai | 144/144 R |
| 5,538,449 A | | 7/1996 | Richard | 440/1 |
| 5,586,921 A | * | 12/1996 | Kobayashi et al. | 114/274 |
| 6,159,059 A | | 12/2000 | Bernier et al. | |
| 6,231,410 B1 | | 5/2001 | Bernier et al. | |

FOREIGN PATENT DOCUMENTS

| | | |
|---|---|---|
| CA | 2207938 | 7/1998 |
| EP | 0 388 228 | 9/1990 |
| FR | 2 687 364 | 8/1993 |

OTHER PUBLICATIONS

Sea.Doo® Jet Boats, Challenger 1800 5600/5601, Catalogue of Pieces, Parts Catalogue, (1997).

* cited by examiner

*Primary Examiner*—Stephen Avila
(74) *Attorney, Agent, or Firm*—Pillsbury Winthrop LLP

(57) ABSTRACT

A steering control system is provided that provides thrust for steering control in a watercraft that is powered by a propulsion unit. The steering control system is applicable to various types of watercraft, including boats and personal watercraft, that are powered by inboard jet propulsion systems or outboard engines. The steering control system is activated by the steering helm assembly and/or an electronic control mechanism. Thrust is provided by preferably controlling the throttle, or more particularly the air-fuel mixture of the carburetor of the engine. The system is particularly, although not solely, suited for steering while the watercraft is operated at low speeds.

53 Claims, 7 Drawing Sheets

WATERCRAFT WITH STEER-RESPONSE ENGINE SPEED CONTROLLER

This application is a continuation of application Ser. No. 08/782,490, filed Jan. 10, 1997, now abandoned and hereby incorporated by reference.

BACKGROUND OF THE INVENTION

1. Field of the Invention

This invention relates to a steering system for a watercraft vehicle powered by a jet propulsion unit. More particularly, this invention relates to a novel apparatus for controlling steering and movement of a watercraft vehicle when the engine is operating at a reduced speed and a means for controlling the thrust of the water exiting the jet propulsion unit at corresponding low engine speeds.

2. Discussion of Related Art

Directional control of watercraft vehicles depend upon the thrust of the water exiting a jet propulsion unit. As the thrust of the water exiting the venturi and the exit nozzle of the jet propulsion unit decreases so does the engine speed of the watercraft vehicle. A conventional jet propulsion unit 210 for a watercraft is shown in FIG. 7 and is comprised of an inner housing and an outer housing. The outer housing comprises a water inlet portion 215 for allowing water into the propulsion unit. At low speed, the jet propulsion unit 210 creates a vacuum force at the intake through which the water travels. In a preferred embodiment, the water inlet portion is comprised of an intake grate like member, as shown at 215. The intake grate is attached to the outer housing by means of screws at a distal end of the outer housing, and it allows for the free flow of water while protecting the jet propulsion unit 210 and its parts, such as an impeller 242, from pulling any harmful debris into the jet propulsion unit 210.

The outer housing further comprises a support 218 at a proximal end for receiving the impeller 242, an impeller housing assembly 240, and a venturi 230. The support 218 comprises a circularly shaped aperture extending through the center of the support 218, and is adapted for receiving the impeller 242. In addition, the support 218 comprises a means for receiving the impeller housing assembly 240 and is secured thereto by means of fasteners and o-rings. The support 218 and the impeller housing assembly 240 are both adapted for receiving the impeller 242 and its associated wear-ring 246. The impeller 242 comprises a plurality of blades 248 and a wear-ring 246 which surrounds the impeller 242 as it spins. The impeller 242 spins inside very tight tolerances within the propulsion unit 210. The wear-ring 246 surrounds the impeller 242 such that if there is a problem the impeller 242 will damage an easy to replace item instead of the entire jet propulsion unit 210. The impeller 242 further comprises an impeller shaft 244 which is connected to the drive shaft of the engine through the impeller 242 The drive shaft of the engine causes the impeller 242 to rotate during use of the watercraft vehicle. At low speed, it is the rotation of the impeller 242 which creates a vacuum that pulls water into the inlet 215 of the jet propulsion unit 210. As the water approaches the rotating impeller 242, the blades 248 of the impeller 242 force the water toward a venturi 230 and a steering nozzle 228 at a stem end of the vehicle. It is the thrust created by the water mass accelerating in the venturi 230 which forces water through the jet propulsion unit 210 and moves the vehicle. The configuration of the jet propulsion unit 210 together with the impeller 242 allows the spinning impeller 242 to thrust water through the venturi 230.

The impeller 242 which is surrounded by a wear-ring 246 is further enclosed within an impeller housing 240 comprising a distal end 241 and a proximal end 249. The distal end 241 of the impeller housing 240 comprises a plurality of apertures for receiving attaching means and securing the impeller housing 240 to the support 218. The proximal end 249 of the impeller housing 240 has a plurality of apertures for securing the impeller housing 240 to a nozzle assembly 250. The impeller housing 240 further comprises stator vanes 224 formed integrally within the impeller housing 240. The spinning action of the impeller 242 causes the water to leave the impeller housing 240 in a swirling torrent of inefficient force. The stator vanes 224 located aft of the impeller 242 function to align the water as it moves away from the impeller housing 240. Attached to a proximal end of the impeller housing 249 is a thrust cone 226 for directing the water to the nozzle assembly 250. The thrust cone 226 controls the acceleration of the water as it exits the stator vanes 224 during its acceleration through the nozzle assembly 250.

The nozzle assembly 250 is attached to the secondary housing by means of screws. The steering nozzle 228 works to push the exiting water rearward in a controlled stream of propulsion. As shown in FIG. 1, the venturi 230 is distal of the steering nozzle 228 and functions to control the thrust and velocity of the water flow exiting the impeller housing 240. Accordingly, the water exiting the venturi 230 enters the steering nozzle 228 which redirects the water exiting the jet propulsion unit 210, allowing for controlled maneuvering of the watercraft vehicle.

Typically, the directional control and movement of the watercraft vehicle at low speeds has been through activating the engine throttle to increase engine speed and create an increased thrust from the water exiting the jet propulsion unit. In general, the throttle controls the thrust of the water passing through and exiting the jet propulsion unit by regulating engine speed, thereby controlling the speed of the vehicle and allowing the operator to move a steering helm wheel, or a similar means, to control the directional movement of the vehicle. Accordingly, it has become common practice in the art for an operator to manually utilize the throttle together with the steering helm wheel in order to regulate the direction and velocity of water exiting the jet propulsion unit, thereby controlling the watercraft vehicle's direction for travel.

Several steering control apparatus for watercraft vehicles have been patented. The steering control apparatus disclosed in the Prior Art comprise means for controlling the direction of the fluids exiting the nozzles, thereby controlling the direction of travel of the vehicle. However, none of the patents disclose a means for controlling movement of the watercraft vehicle at low speeds by means of activating and controlling the carburetor and the air-fuel mixture being supplied to the carburetor. Furthermore, the Prior Art fails to disclose means for controlling the thrust and directional control of the vehicle at low speeds through the exclusive use of the steering helm assembly.

Therefore, what is desirable is a novel steering apparatus for a jet propulsion unit for a watercraft vehicle having a means for controlling the air-fuel mixture of the carburetor and corresponding internal combustion engine, wherein the thrust of the water exiting the venturi and corresponding exit nozzle may be alternatively controlled by the steering helm assembly or a series of electronic sensors and switches. The apparatus is variable among several different positions so that the steering helm assembly or an electronic control means may each be alternatively activated to control the thrust as well as directional movement of the vehicle during alternative riding conditions when the engine speed is low or reduced.

SUMMARY OF THE INVENTION

It is therefore the general object of the present invention to provide a low speed steering system for a watercraft vehicle for controlling and enhancing the directional movement of a watercraft vehicle at such speeds.

It is a further object of the invention to provide a plurality of cables within the low speed steering system for controlling the thrust of the jet propulsion unit by means of the steering helm assembly. By placing the throttle control in an off position, the operator may control the thrust of the water exiting the jet propulsion unit exclusively by means of the steering helm.

It is an even further object of the invention to provide an electronic control means within the steering system for applying a minimal thrust to the jet propulsion unit. At such time as the throttle is set to an off position, the electronic control means may provide a minimal thrust to the jet propulsion unit for enhancing docking and other directional movements of the watercraft vehicle.

Furthermore, it is a further object of the invention to provide a biasing means for controlling the air-fuel mixture flowing into the carburetor of the watercraft vehicle. A plurality of cables or electronic sensors and switches are connected to a carburetor biasing means for alternatively controlling the air-fuel mixture flow into the carburetor.

Another object of the invention is to control the thrust of the engine and the directional control of the vehicle by means of rotating the steering helm assembly in a given clockwise or counter-clockwise direction. By setting the throttle to an off position, the directional control of the vehicle together with the thrust of the water exiting the jet propulsion unit may be controlled by means of the steering helm assembly.

It is an even further object of the invention, to provide a plurality of cables, a cable support and a slide coupler means connecting the throttle and the steering helm assembly to a biasing means for the carburetor. The slider coupler means, together with the cable support, function to control the carburetor actuator means and to allow either the throttle or the steering helm assembly to control the thrust of the water exiting the jet propulsion unit.

In accordance with the invention, these and other objectives are achieved by providing a low speed steering system comprising a novel means for controlling the thrust of the water exiting the jet propulsion unit for enhancing docking and other directional control movements of a watercraft vehicle. Accordingly, the novel low speed steering system configuration enables an operator of the vehicle to directionally control steering of the watercraft vehicle by means of the steering helm assembly when the throttle is set in an off position.

BRIEF DESCRIPTION OF THE DRAWINGS

These and other objects, features and advantages of the invention, as well as the invention itself, will become better understood by reference to the following detailed description when considered in connection with the accompanying drawings, wherein.

DETAILED DESCRIPTION OF THE PREFERRED EMBODIMENTS AND BEST MODE OF THE INVENTION

Figure 1:
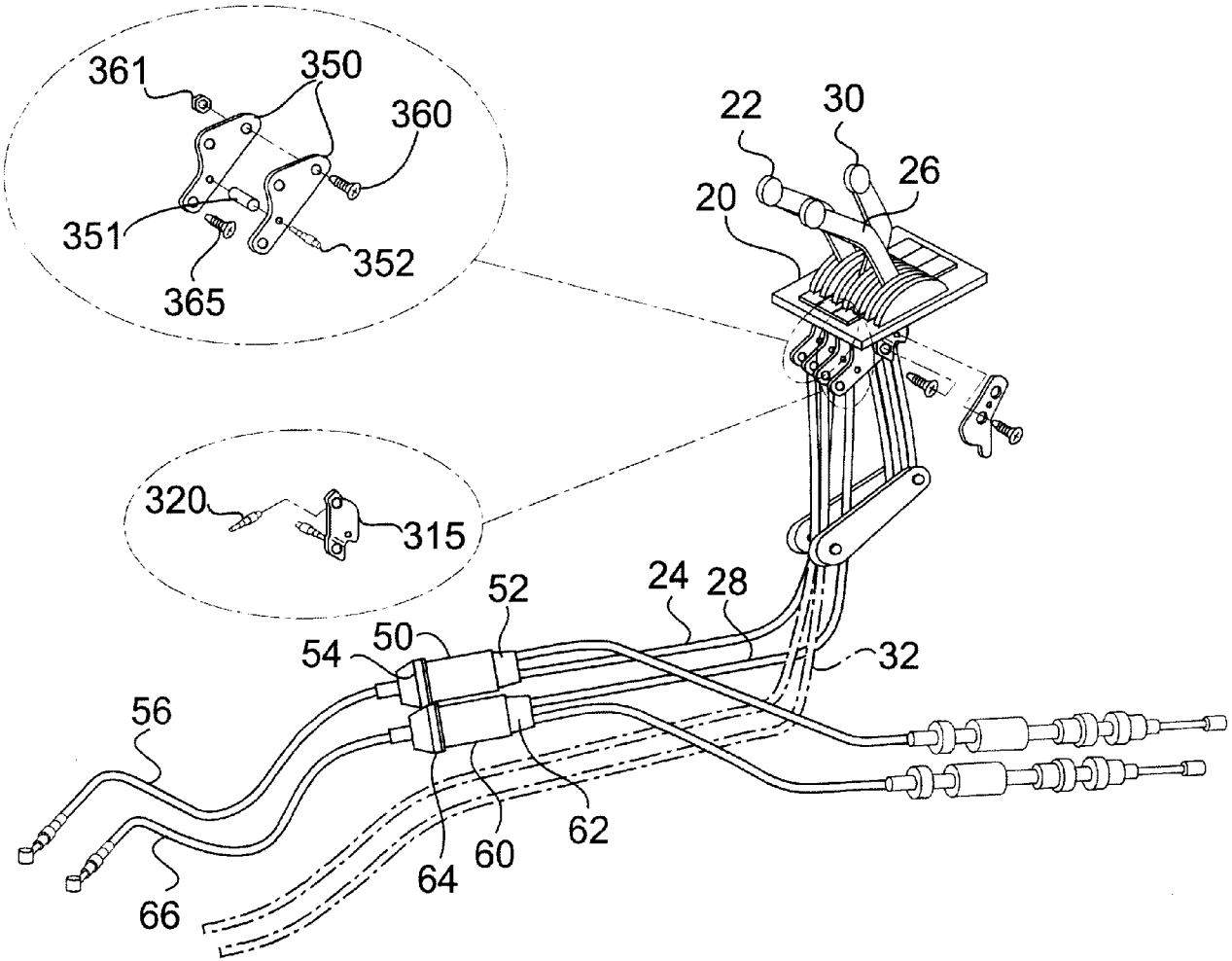
FIG. 1 is a schematic illustration of a conventional steering system of a watercraft vehicle including the low speed steering system in accordance with the present invention.

Although the disclosed invention may have broad applicability, it relates primarily to an apparatus for controlling steering of a watercraft vehicle at low speeds and more specifically to a personal watercraft vehicle or similarly powered watercraft vehicle. This invention is applicable to all watercraft vehicles propelled by means of a jet propulsion unit, including those configured with an impeller as well as those configured with an outboard motor. The following description will indicate certain items as occurring in pairs when either one or both items are shown in the accompanying drawings. It is to be understood that the portion of each pair which is not shown is identical to the illustrated part and performs the same function as the illustrated item. Accordingly, it should be noted that like reference numerals are used throughout the attached drawings to designate the same or similar elements or components.

In a conventional watercraft vehicle, it is difficult to control directional movement of the vehicle at low speeds at such time as an operator is maneuvering the watercraft vehicle at low speeds, such as in a docking procedure or a specially controlled positioning procedure. In general, greater thrust of the water exiting the jet propulsion unit improves the steering and directional control available to the operator of the vehicle. Accordingly, the novel arrangement of the low speed steering system provides improved directional control of a watercraft vehicle when it is operating at low engine speeds with a decreased thrust as well as enhanced direction control at such time as the watercraft vehicle operates at higher engine speeds and an increased thrust.

Referring now to the drawings, FIG. 1 illustrates a schematic illustration of a twin engine arrangement for a watercraft vehicle having a conventional steering system. Although this illustration is of a twin engine arrangement, the steering system is equally applicable to a watercraft vehicle having a single engine arrangement. Furthermore, this invention is applicable to all types of watercraft vehicles, including personal watercraft vehicles and similarly powered watercraft vehicles. In a twin engine arrangement, the throttle assembly 20 is comprised of three levers 22, 26 and 30. The first and second levers 22 and 30, are for independently controlling performance of the two engines of the vehicle and the thrust of the water exiting the jet propulsion unit of the corresponding engine. A third lever 26 is for controlling forward, reverse and neutral movement of the vehicle. Activation of each engine may be controlled independently by adjustment of the first and second throttle levers 22 and 30 independently. By separately adjusting and controlling the first and second throttle levers 22 and 30, the operator of the vehicle can separately control performance of each of the engines and manipulate the performance and directional control of the vehicle. Some vehicles which comprise a twin engine arrangement may comprise separate throttle levers for each of the engines, but only a single steering cable for the corresponding exit nozzles. In this specific configuration, the corresponding exit nozzles are coupled together. Furthermore, in a vehicle which comprises a single engine arrangement, there are two throttle levers, one lever for controlling forward, reverse and neutral movement of the vehicle and a second lever for controlling performance of the engine.

The throttle assembly 20 comprises a plurality of cables extending from a distal end of the assembly. In a conventional twin engine steering system, a first set of cables 24 and a second set of cables 28 extend from the distal end of the first and second throttle levers 22 and 30 to the carburetors of each of the engines (not shown). The first set of cables 24 extend from the first throttle lever 22 to the left engine and the second set of cables 28 extend from the second throttle lever 30 to the right engine. More specifically, the first and second sets of cables, 24 and 28, each attach to a biasing means 40 and 45 of each of the respective carburetors for controlling the air-fuel mixture in each of the carburetors by means of slide couplers 50 and 60. A third set of cables 32 extend from a distal end of the third throttle lever 26 to an exit nozzle of the jet propulsion unit (not shown) and controls the directional displacement of the water exiting the nozzle and the movement of the watercraft vehicle.

Figure 2:
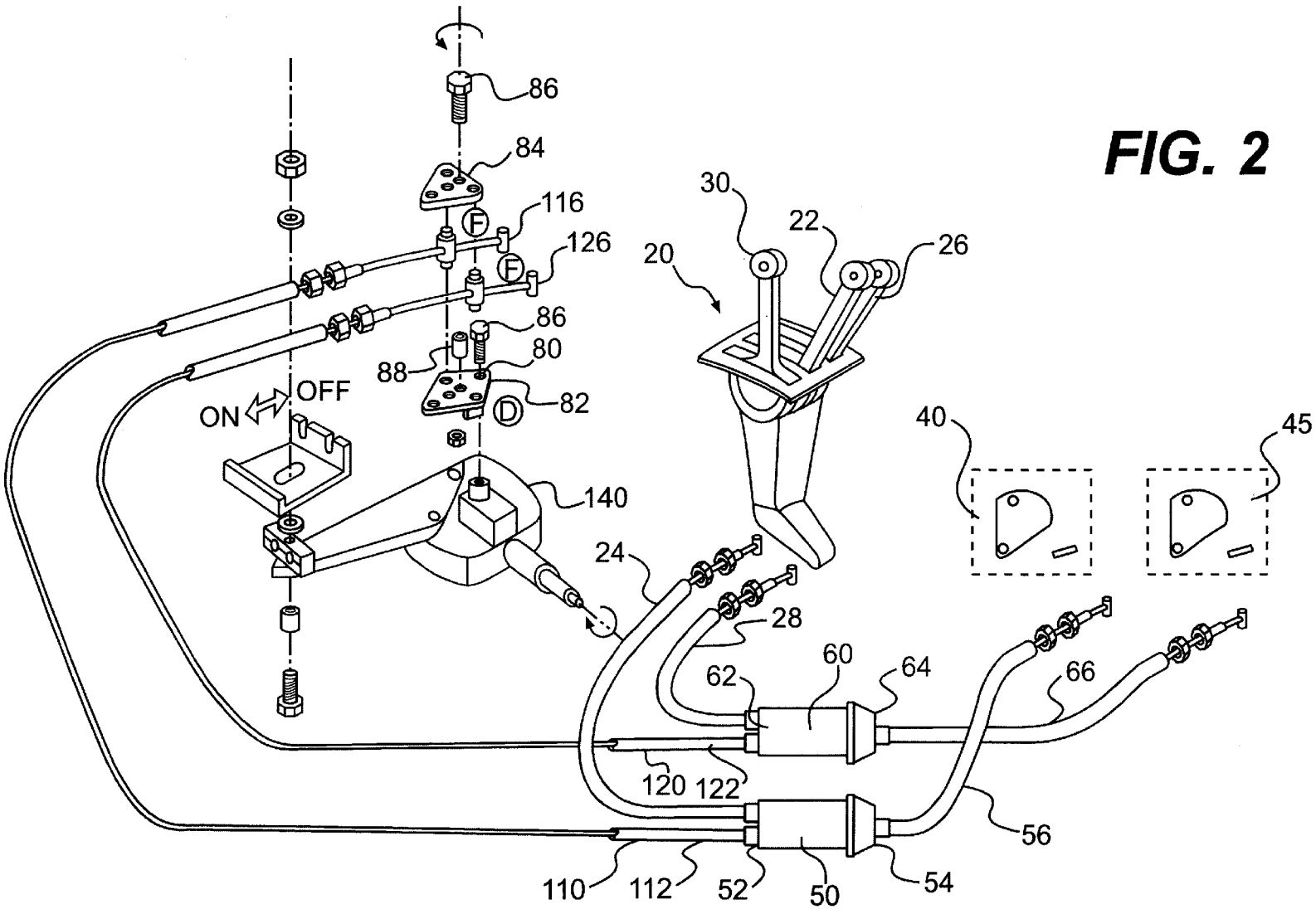
FIG. 2 is a schematic illustration of a novel low speed steering system of a watercraft vehicle of the present invention.

In the novel steering system of the present invention, as illustrated in FIG. 2, the throttle assembly comprises a first set of cables 24 and a second set of cables 28. The first set of cables 24 extend from the first throttle lever 22 to a carburetor biasing means 40 of the left engine by means of a left slide coupler 50. The second set of cables 28 extend from the second throttle lever 26 to a carburetor biasing means 45 of the right engine by means of a right slide coupler 60. The first set of cables 24 extend from the first throttle lever 22 to a proximal end 52 of the left slide coupler 50. The second set of cables 28 extend from the second throttle lever 30 to a proximal end 62 of the right slide coupler 60. Both the first set of cables 24 and the second set of cables 28 attach to the respective slide couplers 50 and 60 at a proximal end. Accordingly, the first throttle lever 22 controls the engine on the left side of the vehicle and the second throttle lever 30 controls the engine on the right side of the vehicle.

Both the left slide coupler 50 and the right slide coupler 60 each comprise a proximal end 52 and 62 and a distal end 54 and 64, respectively. The proximal ends 52 and 62 of the slide couplers 50 and 60 are adapted to receive the first and second cables 24 and 28 extending from the first and second throttle levers 22 and 30. The distal end 54 and 64 of the slide couplers 50 and 60 comprise an additional set of cables extending therefrom. The first cable 56 extends from the distal end 54 of the left slide coupler 50 to the biasing means of the left carburetor 40, and the second cable 66 extends from the distal end 64 of the right slide coupler 60 to the biasing means of the right carburetor 45. The proximal end of the slide couplers 50 and 60 are further adapted to receive an additional set of cables 110 and 120 extending from the steering helm assembly 140. Accordingly, the proximal end of the slide couplers 50 and 60 are adapted to receive a plurality of cables from both the steering helm assembly 140 and the throttle assembly 20 and to control the connection of each set of cables to the left and right engines of the watercraft vehicle.

Figure 3:
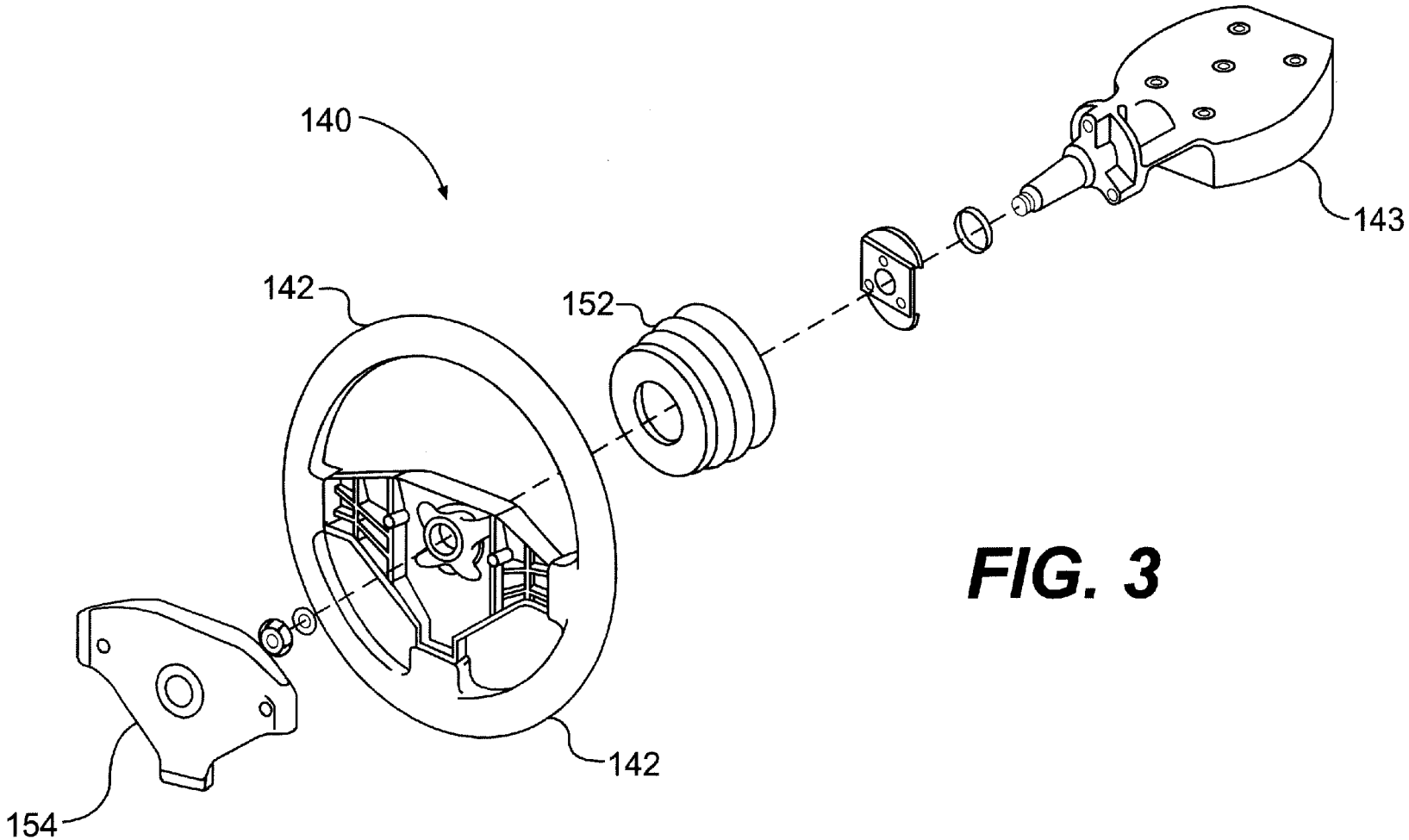
FIG. 3 is an exploded view of a conventional steering system for a watercraft vehicle.
Figure 4:
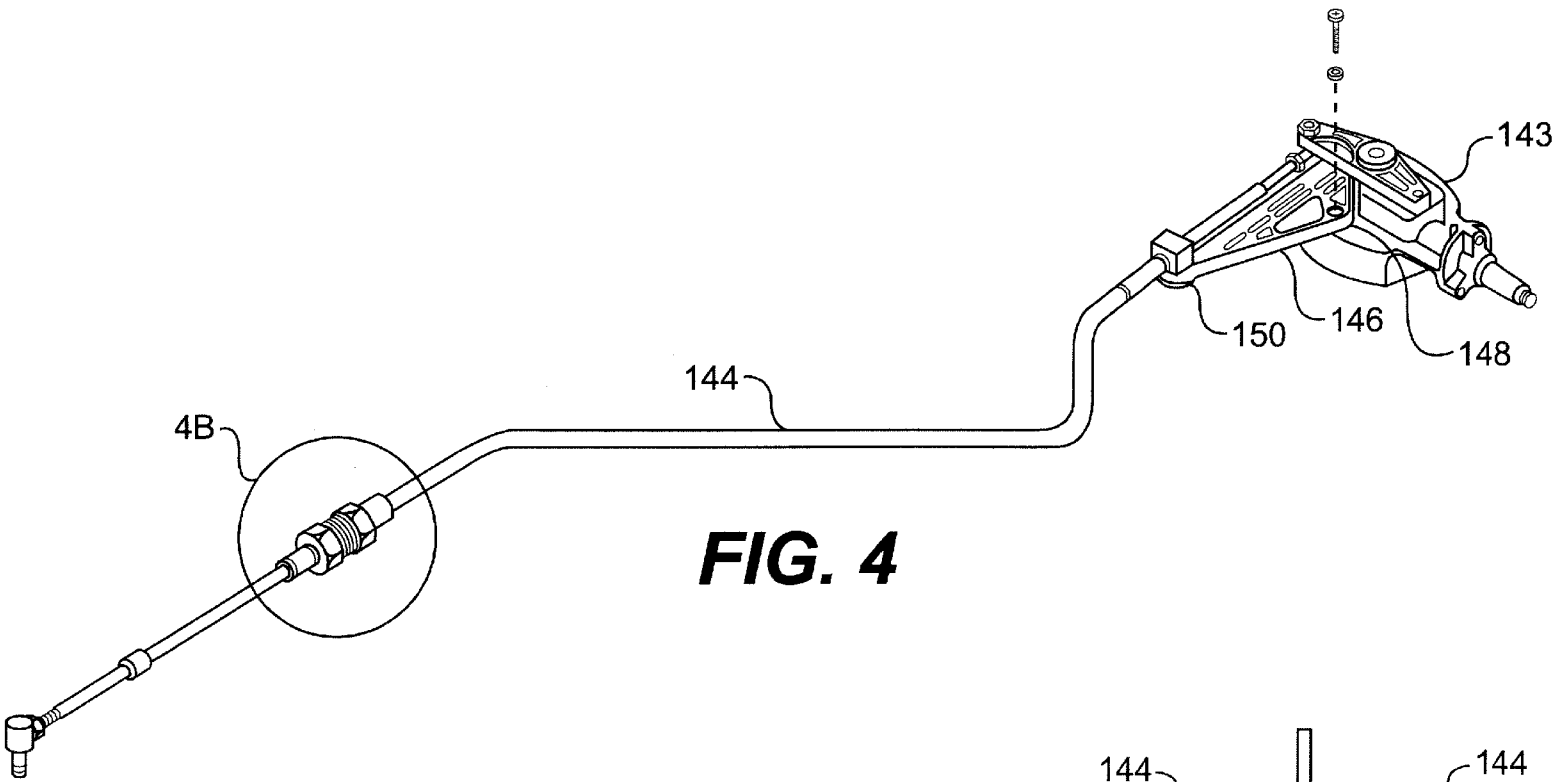
FIG. 4 is a schematic illustration of a conventional steering helm.
Figure 4B:
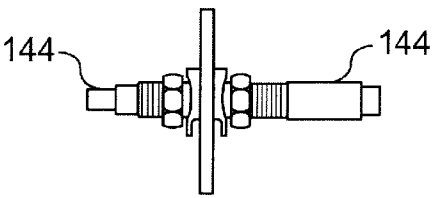
FIG. 4B is an enlarged view of section 4B circled in FIG. 4.

FIG. 3 is illustrative of an external portion of a conventional steering helm assembly 140 for a watercraft vehicle, including the steering wheel 142 and the steering helm 143. The steering helm assembly 140 controls steering of the watercraft vehicle by means of a steering cable 144 which extends from the steering wheel 142 to an exit nozzle adjacent to the jet propulsion unit of the watercraft vehicle. FIG. 4 is a schematic of the steering assembly of the present invention. As shown in FIG. 4, the steering cable 144 extends from a distal portion of the steering helm assembly to the hull portion of the watercraft vehicle. The steering cable 144 further extends from a rear portion of the hull 156 to a pivot connection 158 adjacent the exit nozzle of the jet propulsion unit. The conventional steering helm assembly 140 further comprises a support cable 146 having a distal end 148 extending from an underside portion of the steering helm assembly toward the steering cable 144. The support cable 146 is configured to support the steering cable 144 adjacent to a distal end 148 of the steering helm assembly 140. A proximal end 150 of the steering helm assembly 140 has the steering cable 144 extending therefrom and through the steering column. The steering helm 140 further comprises a collar 152 surrounding the steering cable 144 adjacent to the proximal end of the steering helm assembly 140. The collar 152 extends from the proximal end of the steering helm assembly 150 to a central portion of the steering wheel 142, which has an aperture through its central portion for receiving the collar 152 and the steering cable 144. The front surface of the steering wheel 142 comprises a center steering portion 154 for receiving the steering cable 144 and enclosing the aperture extending through the steering wheel 142. Accordingly, a conventional steering helm assembly comprises a steering cable 144 extending from the steering wheel to the exit nozzle of the jet propulsion unit so that rotation of the steering wheel allows the operator to control the directional movement of the exit nozzle.

Figure 5:
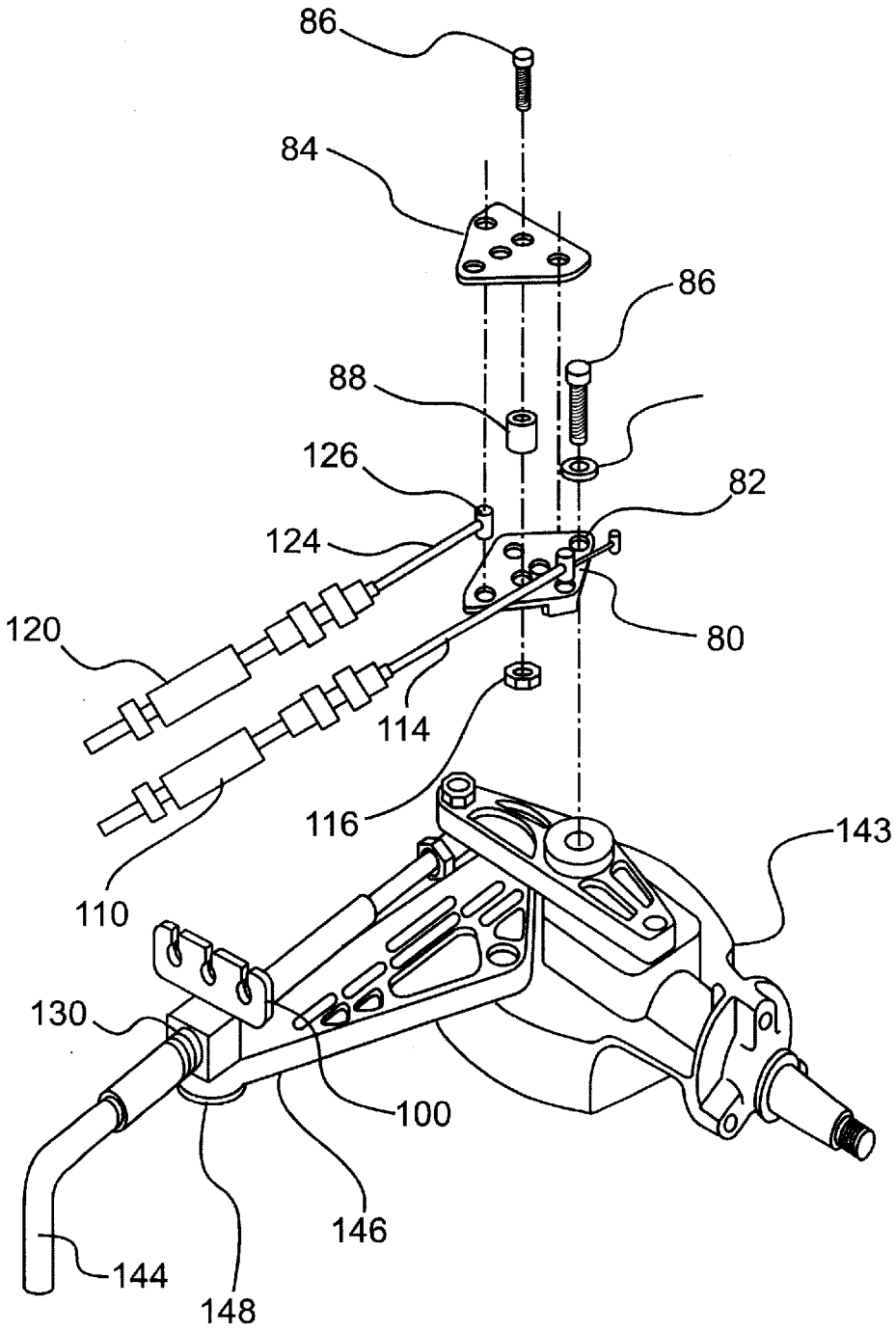
FIG. 5 is an exploded view of the novel steering system of a watercraft vehicle of the present invention.
Figure 6:
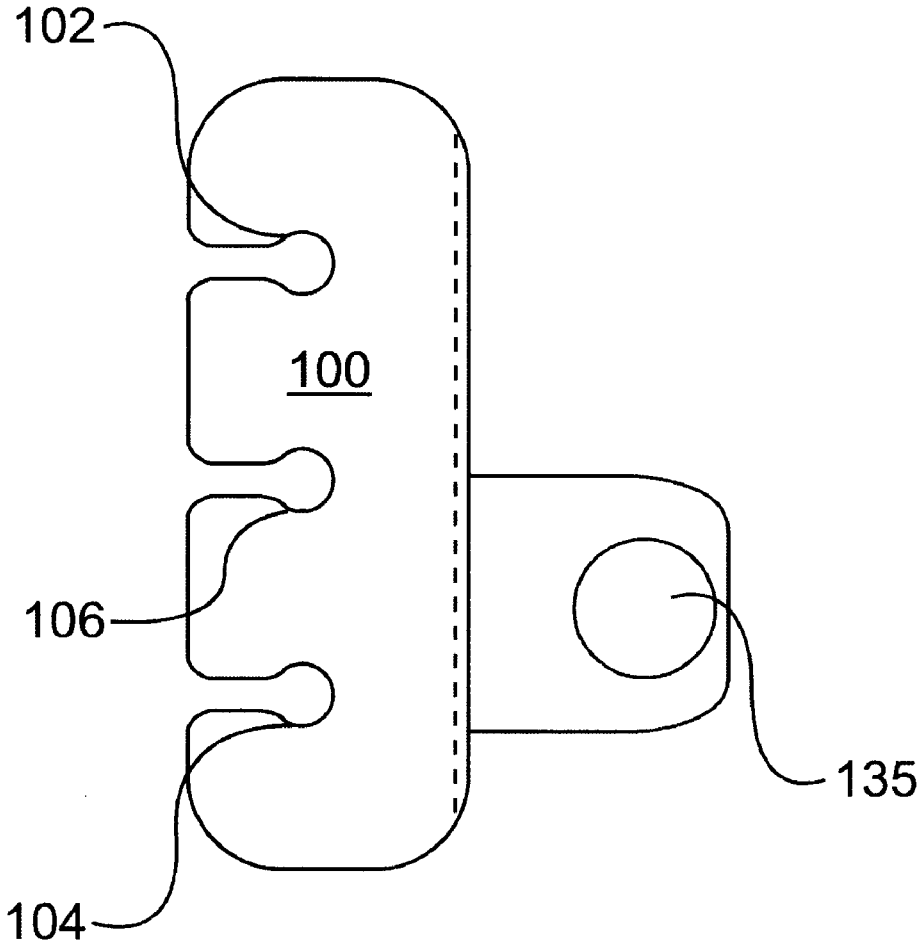
FIG. 6 is a side elevational view of a cable support of the novel low speed steering system of a watercraft vehicle of the present invention.
Figure 7:
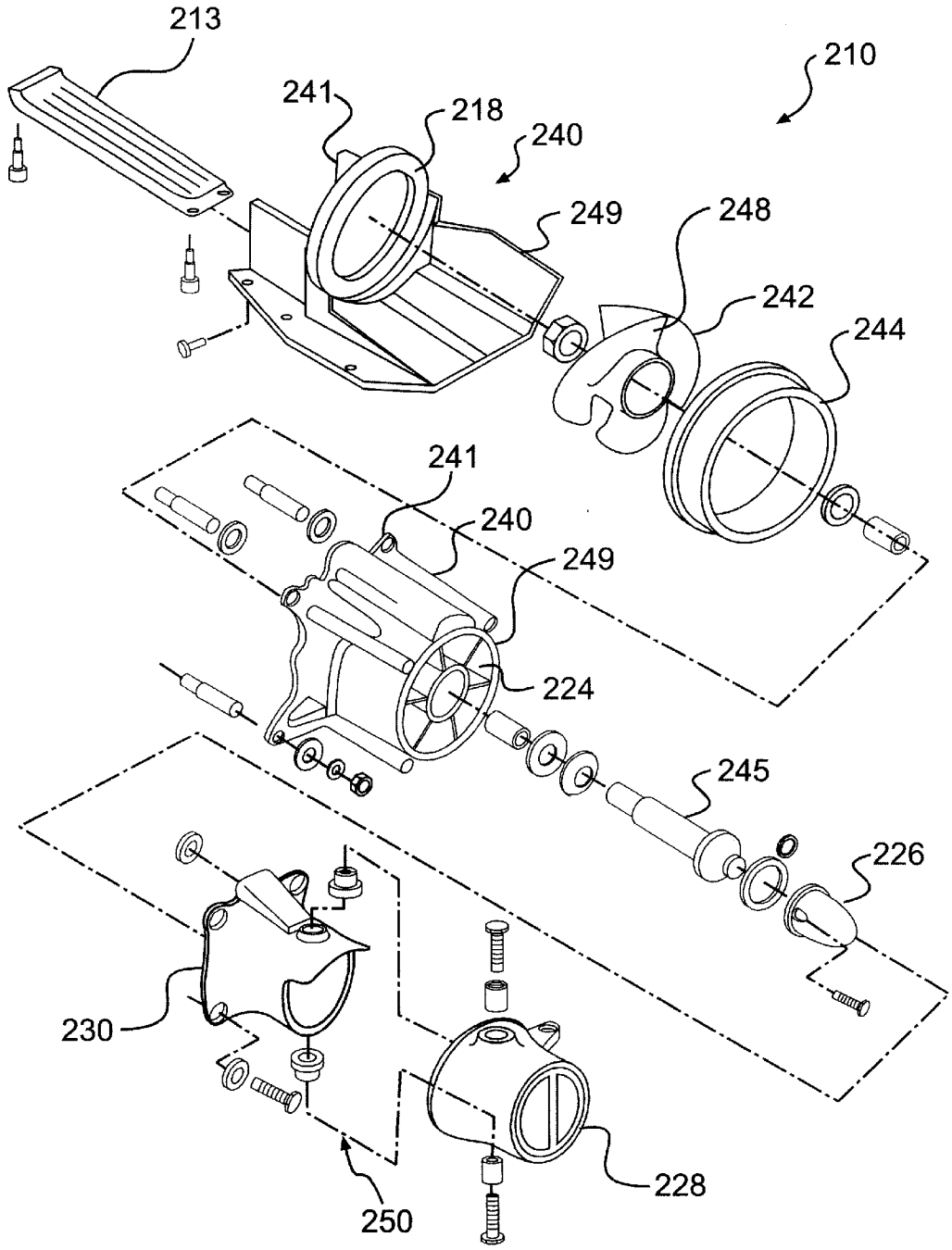
FIG. 7 is a schematic illustration of a conventional jet propulsion unit of a watercraft vehicle.

The novel steering system comprises a cable support 100 which is attached to and made a part of the steering helm assembly 140 adjacent to the distal end of the steering helm assembly 148, as illustrated in FIGS. 5 and 6. The cable support 100 comprises a support 130 having an aperture 135 for securing the cable support 100 to the steering cable 144 adjacent to a proximal end of the support cable 146. In a twin engine configuration, the novel steering system comprises a first cable 110 and a second cable 120 extending from each of the left and right slide couplers 50 and 60 to the cable support 100. The first cable 110 comprises a proximal end 112 which is attached to the left slide coupler 50 and is mounted to a first slot 102 of the cable support. Similarly, the second cable 120 comprises a proximal end 122 which is attached to the right slide coupler 60 and is mounted to a third slot 104 of the cable support 100. In a single engine configuration, there is only a single cable extending from a single slide coupler to the cable support 100 and the single cable is mounted in the center slot 106 of the cable support 100.

The novel steering helm assembly 140 further comprises a clamp 80 mounted on and connected to a top surface area of the steering helm assembly 140, as shown in FIGS. 2 and 5. The clamp 80 comprises an aperture 82 at a distal end for receiving a screw for securing the clamp 80 to the steering helm assembly 140. The clamp further comprises a plurality of apertures adjacent to a proximal end of the clamp. These apertures are adapted for receiving and containing the distal end 114 of the first cable 110 and the distal end 124 of the second cable 120. In a single engine arrangement, the clamp 80 is adapted to receive a single cable in the central slot of the clamp 80. As illustrated in FIGS. 2 and 5, the distal ends of the first and second cables 110 and 120 each comprise a stopper 116 and 126, respectively. The stoppers 116 and 126 are permanently affixed to the distal end of each of the first and second cables 110 and 120 and are received by the clamp 80. Accordingly, the distal ends of the first and second cables 114 and 124 are attached to the clamp 80 and held in place by means of the stoppers 116 and 126.

The clamp 80 further comprises an upper clip 84 fitting over a top surface of the clamp 80. The upper clip 84 comprises a plurality of apertures for receiving screws 86 and securing the upper clip 84 to the clamp 80. In a further embodiment, the novel steering helm assembly 140 further comprises a spacer 88 disposed between the clamp 80 and the upper clip 84, to provide space (a gap) there between for receiving a plurality of cylinders (not shown) adjacent to the distal ends 114 and 124 of the first and second cables 110 and 120. Each of the cylinders receive the stoppers 116 and 126 at the distal end of each of the cables 110 and 120. In a single engine arrangement, the steering helm assembly comprises a single cylinder for receiving a stopper at a distal end of a single cable. Both the clamp 80, the upper clip 84, and the cylinders are rotatable and allow the first and second cables 110 and 120 to rotate with the rotational movement of the steering wheel 142. As the steering wheel 142 is rotated, the steering cable 144 is rotated and controls the directional movement of the exit nozzle and the watercraft vehicle. In addition, the cylinders are adapted to push or pull the cables 110 and 120 by means of the corresponding stoppers 116 and 126, depending upon the directional rotation of the steering wheel 142. When the watercraft vehicle is at rest, the stoppers 116 and 126 of each of the respective cables 110 and 120 are located in a midsection of each of the respective cylinders. Accordingly, as the steering wheel 142 is rotated in a clockwise or counterclockwise direction, the cylinders rotate together with the clamp 80 and the upper clip 84.

At such time as the vehicle is in a rest position and the throttle levers 22 and 30 are in an off position, the steering wheel 142 may be rotated in a given clockwise position in order to activate the low speed steering system. When the throttle levers are set in an off position, the engine is calibrated to idle. The engine may be shut off only by activation of a separate switch. The rotation of the steering wheel from a rest position to a given position causes the cylinder holding the stopper 126 of the second cable 120 attached to the right slide coupler 60 to be pulled, and the cylinder holding the stopper 116 of the first cable 110 attached to the left slide coupler 50 to be pushed. This action of the steering wheel 142 causes the activation of the carburetor biasing means 45 of the right engine. Similarly, at such time as the vehicle is in a rest position and the throttle levers 22 and 30 are in an off position, the steering wheel 142 may be rotated a given degree in a counter-clockwise direction. The rotation of the steering wheel from a rest position to a given position causes the cylinder holding the stopper 116 of the first cable 110 to be pulled, and the cylinder holding the stopper 126 of the second cable 120 attached to the right slide coupler 60 to be pushed. This rotation of the steering wheel 142 further causes activation of the biasing means 40 attached to the left engine by means of the cable support 100 and the left slide coupler 50. Depending upon calibration of the novel steering assembly, rotation of the steering wheel in a clockwise or counter-clockwise direction for activation of the low speed steering system may be approximately 180°. At such time as the steering wheel 142 is returned to a straight maneuvering position from a given clockwise or counter-clockwise rotation, the respective carburetor biasing means 40 and 45 cause the first and second cables 110 and 120 to return to their rest positions. Accordingly, at such time as the vehicle is in a rest position and the steering wheel is rotated a given degree in a clockwise or counter-clockwise direction, the cylinder holding the distal ends of the cables will control the pulling and activation of the carburetor biasing means of either the left or right engine, thereby controlling rotation of the vehicle engine as well as the thrust and directional movement of the watercraft vehicle.

The left and right slide couplers 50 and 60 control activation of the left and right side engines of the vehicle depending upon activation of the throttle assembly 20 or the steering helm assembly 140. The slide couplers 50 and 60 control the movement received from the throttle levers 22 and 30 as well as movement received from rotation of the steering wheel 142. The proximal ends 52 and 62 of the slide couplers 50 and 60 are adapted to receive both the first and second sets of cables 24 and 28 from the first and second throttle levers 22 and 30 as well as the first and second sets of cables 110 and 120 from the cable support 100 and the steering helm assembly 140. However, the distal ends of the slide couplers comprise only one cable extending from each of the slide couplers. A first cable 56 extends from the left slide coupler 50 to the left engine carburetor biasing means 40, and a second cable 66 extends from the right slide coupler 60 to the right engine carburetor biasing means 45. Both the first cable 56 and the second cable 66 independently control actuation of the biasing means of the carburetors of the respective engines.

Upon activation of either the first throttle lever 22 or the second throttle lever 30, the respective cable extending to the slide coupler actuates the cable extending to the biasing means of the respective carburetor. The same action causes the activated slide couplers to tighten control on the activated cables and to provide an increased backlash (slack) in the cable extending from the slide coupler to the steering assembly 140. The increased backlash in the cables 110 and 120 extending from the slide coupler to the steering helm assembly 140 allows directional control of the vehicle by the steering helm assembly 140 through the steering cable 144 without adjustment to the biasing means of the carburetor. Accordingly, this arrangement allows standard directional control of a watercraft vehicle by means of the steering helm assembly 140 at such time as the throttle lever is activated to control the thrust of the water exiting the jet propulsion unit.

In an alternative configuration, when the throttle is set to an off position, both steering and thrust may be activated by the steering helm assembly 140. Depending upon which direction the operator needs to move the vehicle, the operator may rotate the steering wheel 142 a given degree in either a clockwise or counter-clockwise direction. It is important to note that a clockwise or counter-clockwise rotation of a steering wheel of a watercraft vehicle by a given degree of rotation from a straight alignment of the vehicle may activate the low speed steering system, but the degree of rotation needed for activation may differ according to the calibration of the steering assembly. Rotation of the steering wheel 142 in a clockwise direction causes rotation of the left cylinder which pulls on the first cable 110 attached to the proximal end of the left slide coupler 52. This rotation of the steering wheel 142 further causes a backlash in the cable extending from the left slide coupler 50 to the first throttle lever 22. Furthermore, the clockwise rotational movement allows the first cable 110 to actuate the first cable 56 extending from the distal end of the left slide coupler 54 to the biasing means of the carburetor of the left engine 40. Similarly, rotation of the steering wheel 142 in a counter-clockwise direction causes rotation of the right cylinder which pulls on the second cable 120 attached to the proximal end of the right slide coupler 60. This rotation of the steering wheel 142 further causes a backlash in the second cable 28 extending from the right slide coupler 60 to the second throttle lever 30 and allows the second cable 120 to actuate the second cable 66 extending from the distal end of the right slide coupler 64 to the carburetor biasing means of the right engine 45.

At such time as the first and second throttle levers 22 and 30 are set to an off position, rotation of the steering wheel 142 actuates the left or right engine and controls the thrust of the water exiting the jet propulsion unit and speed of the engine. The degree of rotation of the steering wheel 142 together with the backlash in the cables extending from the first and second throttle levers 22 and 30 to the left and right slide couplers 50 and 60 will determine adjustment of the engine speed and the thrust of the water exiting the jet propulsion unit. Control of the watercraft vehicle by means of the steering helm wheel 142 may produce from about 0 to about 50 pounds of thrust exiting the jet propulsion unit and an engine speed from about 0 to about 3,000 revolutions per minute. However, the engine speed and thrust generated by rotation of the steering wheel may be calibrated as required. At such time as the steering helm wheel 142 is rotated a given degree in a clockwise or counter-clockwise direction from a neutral position, the amount of thrust produced together with the engine speed is sufficient to enable control of directional movement of the vehicle by the operator through movement of the steering wheel 142. The minimal thrust produced by rotation of the steering wheel 142 assists the operator in docking procedures as well as other low speed maneuvers. The necessary degree of rotation of the steering wheel from a neutral position may be approximately 180° to generate a maximum thrust and speed. However, the degree of rotation may be separately calibrated for different vehicles. Accordingly, the directional rotation of the steering helm wheel 142 produces sufficient thrust to enable controlled steering of the watercraft vehicle as well as provide an improved directional control of the vehicle, which may be separately calibrated for different vehicles.

In an alternative embodiment, the low speed steering system may be comprised of a series of electronic controls and wires. This further embodiment comprises a steering helm assembly having sensors or switches for detecting the degree of rotation of the steering wheel. In addition, the carburetor biasing means comprises a separate set of switches for controlling the air-fuel mixture entering each of the respective carburetors. At such time as the throttle levers 22 and 30 are set to an off position and the engine continues to idle, the steering wheel may be rotated to a given degree in a clockwise or counter-clockwise direction. When the steering wheel is rotated in a clockwise direction a first set of sensors or switches adjacent to the steering wheel activate the carburetor biasing means of the right carburetor. Similarly, as the steering wheel is rotated in a counter-clockwise direction the first set of sensors or switches adjacent to the steering wheel activate the carburetor biasing means of the left carburetor. In a preferred embodiment, the biasing means of the right carburetor is a solenoid switch. The switches and sensors adjacent to the steering wheel are connected to the solenoid switches adjacent to the corresponding right and left carburetors by means of electronic wires. This preferred embodiment sends an electric current through the wires from the steering assembly to the carburetor biasing means, thereby activating the air-fuel mixture in each of the respective carburetors and controlling the engine speed and thrust of the water exiting the jet propulsion unit. Accordingly, as such time as the steering wheel 142 is returned to a neutral maneuvering position from either a given clockwise or counter-clockwise rotation, the sensors and switches adjacent to the steering assembly cause the carburetor biasing means of the respective right and left carburetors to adjust the air-fuel mixture in each of the respective carburetors so that the watercraft vehicle engine returns to a neutral idling position.

The above description is of a novel low speed steering system for controlling the thrust of the water exiting the jet propulsion unit while providing directional control of movement of a watercraft vehicle at low speeds. Although the present invention has been described in connection with preferred embodiments thereof, it will be appreciated by those skilled in the art that additions, deletions, modifications, and substitutions not specifically described may be made without departing from the spirit and scope of the invention as defined in the appended claims and the scope should not be limited to the dimensions indicated hereinabove.

What is claimed:

1. A watercraft comprising:

an engine capable of operating at a speed; and a helm assembly for steering the watercraft, said helm assembly operatively connected to said engine, wherein the speed of said engine increases when said helm assembly is caused to be turned beyond a predetermined position in order to control directional movement of the watercraft.

2. A watercraft as recited in claim 1, wherein the watercraft comprises not more than one engine.

3. A watercraft as recited in claim 2, wherein said engine is operatively connected to an impeller of a jet propulsion unit for generating a thrust of water for propelling the watercraft.

4. A watercraft as recited in claim 3, wherein said helm assembly is operatively connected to a nozzle capable of directing the thrust for steering the watercraft.

5. A watercraft as recited in claim 4, wherein said engine is an internal combustion engine and the watercraft further comprises a throttle control, which allows an operator to control engine speed.

6. A watercraft as recited in claim 5, wherein the speed of said engine increases when said helm assembly is caused to be turned beyond a predetermined position and said throttle control is in an idle position.

7. A watercraft as recited in claim 5, wherein the speed of said engine increases when said helm assembly is caused to be turned beyond a predetermined position and said throttle control is an idle position and the speed of said engine is within a predetermined range.

8. A watercraft as recited in claim 7, wherein the predetermined range is between 0 and 3000 rpm.

9. A watercraft as recited in claim 5, wherein the watercraft further comprises a throttle for controlling entry of at least one combustion component into said engine and said helm assembly is operatively connected to said throttle such that when said helm assembly is caused to be turned beyond a predetermined position said throttle increases an amount of the at least one combustion component entering said engine.

10. A watercraft as recited in claim 9, wherein the watercraft further comprises a carburetor, and said throttle is located within said carburetor.

11. A watercraft as recited in claim 9, wherein said throttle control, said throttle, and said helm assembly are mechanically interconnected.

12. A watercraft as recited in claim 11, further comprising:

a slide coupler, said slide coupler having a proximal end and a distal end;

a first cable set extending from said throttle to the distal end of said slide coupler;

a second cable set extending from the proximal end of the slide coupler to said throttle control; and a third cable set extending from the proximal end of the slide coupler to said helm assembly.

13. A watercraft as recited in claim 9, wherein said throttle control, said throttle, and said helm assembly are electronically interconnected.

14. A watercraft as recited in claim 13, wherein said throttle is a solenoid switch and the watercraft further comprises:

a first electronic sensor capable of detecting a position of said helm assembly;

a second electronic sensor capable of detecting a position of the throttle control; and a least one wire operatively interconnecting the solenoid switch, said first electronic sensor, and said second electronic sensor.

15. A watercraft as recited in claim 5, wherein when said helm assembly is caused to be turned beyond the predetermined position, the speed of said engine increases to a first speed and when said helm assembly is caused to be further turned beyond a second predetermined position, the speed of said engine further increases to a second speed.

16. A watercraft as recited in claim 4, wherein the speed of said engine increases when said helm assembly is turned beyond the predetermined position and the speed of said engine is within a predetermined range.

17. A watercraft as recited in claim 16, wherein the predetermined range is between 0 and 3000 rpm.

18. A watercraft as recited in claim 4, wherein when said helm assembly is caused to be turned beyond the predetermined position, the speed of said engine increases to a first speed and when said helm assembly is caused to be further turned beyond a second predetermined position, the speed of said engine further increases to a second speed.

19. A watercraft as recited in claim 1, further comprising a throttle biasing mechanism coupled to the engine, and wherein the helm assembly is operatively connected to the throttle biasing mechanism to selectively increase engine speed in response to turning of the helm assembly.

20. A watercraft as recited in claim 6, wherein the throttle control comprises a lever.

21. A watercraft as recited in claim 7, wherein the throttle control comprises a lever.

22. A watercraft as recited in claim 9, wherein the throttle control comprises a lever.

23. A watercraft as recited in claim 1, wherein the engine is an internal combustion engine and the watercraft further comprises an actuator operatively connected to the helm assembly and the engine, wherein the actuator controls entry of at least one combustion component into the engine and turning the helm assembly beyond the predetermined position increases an amount of the at least one combustion component entering the engine.

24. A watercraft as recited in claim 23, further comprising a sensor capable of detecting a position of the helm assembly and an electrical connector interconnecting the sensor and the actuator.

25. A watercraft comprising:

a first engine capable of operating at a speed;

a second engine capable of operating at a speed; and a helm assembly for steering the watercraft, wherein said helm assembly is operatively connected to each of said engines and wherein the speed of at least one of said engines increases when said helm assembly is caused to be turned beyond a predetermined position in order to control directional movement of the watercraft.

26. A watercraft as recited in claim 25, wherein each of said engines is operatively connected to an impeller of a jet propulsion unit for generating a thrust of water for propelling the watercraft.

27. A watercraft as recited in claim 26, wherein said helm assembly is operatively connected to at least one nozzle capable of directing the thrust for steering the watercraft.

28. A watercraft as recited in claim 27, wherein each of said engines is an internal combustion engine and the watercraft further comprises:

a pair of throttles, each throttle for controlling entry of at least one combustion component into an associated one of said engines; and at least one throttle control operatively connected to said throttles.

29. A watercraft as recited in claim 28, wherein the speed of said at least one of said engines increases when said helm assembly is caused to be turned beyond a predetermined position and said at least one throttle control is in an idle position.

30. A watercraft as recited in claim 28, wherein the speed of said at least one of said engines increases when said helm assembly is caused to be turned beyond a predetermined position, said at least one throttle control is in an idle position, and the speed of said at least one of said engines is within a predetermined range.

31. A watercraft as recited in claim 30, wherein the predetermined range is between 0 and 3000 rpm.

32. A watercraft as recited in claim 29, wherein the throttle control comprises a lever.

33. A watercraft as recited in claim 30, wherein the throttle control comprises a lever.

34. A watercraft as recited in claim 25, wherein each of the engines is an internal combustion engine and the watercraft further comprises a pair of actuators operatively connected to each engine, wherein each actuator controls entry of at least one combustion component into an associated one of the engines and turning the helm assembly beyond the predetermined position increases an amount of the at least one combustion component entering the engine.

35. A watercraft as recited in claim 34, further comprising a sensor capable of detecting a position of the helm assembly and an electrical connector interconnecting the sensor and each actuator.

36. A method of steering a watercraft having an engine capable of operating at a speed, and a helm assembly for steering the watercraft, the method comprising:

determining a position of the helm assembly;

comparing the determined position of the helm assembly with a predetermined position; and increasing the speed of the engine when the determined position of the helm assembly is turned beyond the predetermined position in order to control directional movement of the watercraft.

37. A method of steering a watercraft as recited in claim 36, the method further comprising:

determining the speed of the engine;

increasing the speed of the engine when the helm assembly is turned beyond the predetermined position and the speed of the engine is within a predetermined range.

38. A method of steering a watercraft as recited in claim 37, wherein the predetermined range is between 0 and 3000 rpm.

39. A method of steering a watercraft as recited in claim 36, the watercraft further comprising a throttle control, the method further comprising:

determining a position of the throttle control;

increasing the speed of the engine when the helm assembly is turned beyond the predetermined position and the throttle control is set to an idle position.

40. A method of steering a watercraft as recited in claim 36, the watercraft further comprising a throttle control, the method further comprising:

determining a position of the throttle control;

determining the speed of the engine; and increasing the speed of the engine when the determined position of the helm assembly is beyond the predetermined position, the throttle control is set to an idle position, and the speed of the engine is within a predetermined range.

41. A method of steering a watercraft as recited in claim 40, wherein the predetermined range is between 0 and 3000 rpm.

42. A method of steering a watercraft as recited in claim 36, wherein the engine has a throttle coupled thereto and the method includes biasing the throttle to change the speed of the engine in response to turning the helm assembly beyond the predetermined position.

43. A method of steering a watercraft as recited in claim 36, wherein the engine is an internal combustion engine and the watercraft further comprising an actuator connected to the engine for controlling entry of at least one combustion component into the engine, the method further comprising:

activating the actuator to increase the amount of at least one combustion component entering the engine when the position of the helm assembly is determined to be beyond the predetermined position.

44. A method of steering a watercraft as recited in claim 43, further comprising determining the speed of the engine and activating the actuator when the speed of the engine is within a predetermined range.

45. A method of steering a watercraft having a pair engines, each engine capable of operating at a speed, and a helm assembly for steering the watercraft, the method comprising:

determining a position of the helm assembly;

comparing the determined position of the helm assembly with a predetermined position; and increasing the speed of at least one of the engines when the determined position of the helm assembly is turned beyond the predetermined position in order to control directional movement of the watercraft.

46. A method of steering a watercraft as recited in claim 45, the method further comprising:

determining the speed of the at least one of the engines; and increasing the speed of the at least one of the engines when the helm assembly is turned beyond the predetermined position and the speed of the at least one of the engines is within a predetermined range.

47. A method of steering a watercraft as recited in claim 46 wherein the predetermined range is between 0 and 3000 rpm.

48. A method of steering a watercraft as recited in claim 45, the watercraft further comprising at least one throttle control, the method further comprising:

determining a position of the at least one throttle control;

increasing the speed of the at least one of the engines when the helm assembly is turned beyond the predetermined position and the at least one throttle control is set to an idle position.

49. A method of steering a watercraft as recited in claim 45, the watercraft further comprising at least one throttle control, the method further comprising:

determining a position of the at least one throttle control;

determining the speed of the at least one of the engines; and increasing the speed of the at least one of the engines when the helm assembly is turned beyond the predetermined position, the at least one of the throttle control is set to an idle position, and the speed of the at least one of the engines is within a predetermined range.

50. A method of steering a watercraft as recited in claim 49, wherein the predetermined range is between 0 and 3000 rpm.

51. A method of steering a watercraft as recited in claim 45 wherein each engine has a throttle coupled thereto and the method includes biasing the throttle to change the speed of the engine in response to turning the helm assembly beyond the predetermined position.

52. A method of steering a watercraft as recited in claim 45, wherein each of the engines is an internal combustion engine and the watercraft further comprising an actuator connected to each engine for controlling entry of at least one combustion component into the engine, the method further comprising:

activating at least one of the actuators to increase the amount of at least one combustion component entering the engine when the position of the helm assembly is determined to be beyond the predetermined position.

53. A method of steering a watercraft as recited in claim 52, further comprising determining the speed of each engine and activating at least one of the actuators when the speed of at least one of the engines is within a predetermined range.

* * * * *

Disclaimer

6,405,669 B2 — Alain Rheault, Longueuil, Canada; Camille Michel, Ste-Foy, Canada. WATERCRAFT WITH STEER-RESPONSE ENGINE SPEED CONTROLLER. Patent dated June 18, 2002. Disclaimer filed October 28, 2005, by the assignee, BRP US INC.

The term of this patent shall not extend beyond the expiration date of Patent No. 6,336,833.

*(Official Gazette, January 10, 2006)*

US006405669C1

(12) INTER PARTES REEXAMINATION CERTIFICATE (0045th)

United States Patent

Rheault et al.

(10) Number: US 6,405,669 C1

(45) Certificate Issued: Jan. 6, 2009

(54) WATERCRAFT WITH STEER-RESPONSIVE ENGINE SPEED CONTROLLER

(75) Inventors: Alain Rheault, St. Nicolas (CA); Camille Michel, Ste-Foy (CA)

(73) Assignee: BRP US Inc., Sturtevant, WI (US)

Reexamination Request:
No. 95/000,179, Sep. 18, 2006

Reexamination Certificate for:

| | |
|---|---|
| Patent No.: | **6,405,669** |
| Issued: | **Jun. 18, 2002** |
| Appl. No.: | **09/904,742** |
| Filed: | **Jul. 16, 2001** |

Related U.S. Application Data

(63) Continuation of application No. 08/782,490, filed on Jan. 10, 1997, now abandoned.

(51) Int. Cl.

| | |
|---|---|
| ***B63H 21/00*** | (2006.01) |
| ***B63H 21/22*** | (2006.01) |
| ***B63H 25/00*** | (2006.01) |
| ***F02D 11/02*** | (2006.01) |
| ***G05G 11/00*** | (2006.01) |
| ***F02B 61/04*** | (2006.01) |

(52) U.S. Cl. ..... 114/144 R; 440/1; 440/84; 440/87

(58) Field of Classification Search ..... 440/1, 440/2, 84, 85, 86, 87; 114/144 R, 144 E
See application file for complete search history.

(56) References Cited

U.S. PATENT DOCUMENTS

| | | | | |
|---|---|---|---|---|
| 4,519,335 A | | 5/1985 | Krautkremer et al. | |
| 4,767,363 A | | 8/1988 | Uchida et al. | |
| 5,094,182 A | | 3/1992 | Simner | |
| 5,203,727 A | * | 4/1993 | Fukui | 114/122 |
| 5,582,125 A | | 12/1996 | Matsumoto | |
| 5,586,921 A | * | 12/1996 | Kobayashi et al. | 114/274 |

FOREIGN PATENT DOCUMENTS

| | | |
|---|---|---|
| CA | 2207938 | 7/1998 |
| CA | 2281401 | 12/2001 |
| JP | 57-084297 | 5/1982 |

OTHER PUBLICATIONS

Definition of "beyond" from Webster's Third New International® Dictionary, Unabridged, Copyright © 1993 Merriam–Webster, Incorporated.*

1997 SeaDoo Jet Boats Shop Manual, vol. 2, Speedster, Challenger, Challenger 1800.

Proposal to study Off–Throttle Steering of Jet–Pump Propelled Craft Grant 18 (1997), Society of Automotive Engineering.

National Transportation Safety Board, Safety Study: Personal Watercraft Safety, NTSB/SS–98/01, May 19, 1998.

Interim Report Off–Throttle Steering of Jet–Pump Propelled Craft Grant 18, Feb. 20, 1999, Society of Automotive Engineering.

* cited by examiner

*Primary Examiner*—Peter C. English

(57) ABSTRACT

A steering control system is provided that provides thrust for steering control in a watercraft that is powered by a propulsion unit. The steering control system is applicable to various types of watercrafts, including boats and personal watercraft, that are powered by inboard jet propulsion systems or outboard engines. The steering control system is activated by the steering helm assembly and/or an electronic control mechanism. Thrust is provided by preferably controlling the throttle, or more particularly the air-fuel mixture of the carburetor of the engine. The system is particularly, although not solely, suited for steering while the watercraft is operated at low speeds.

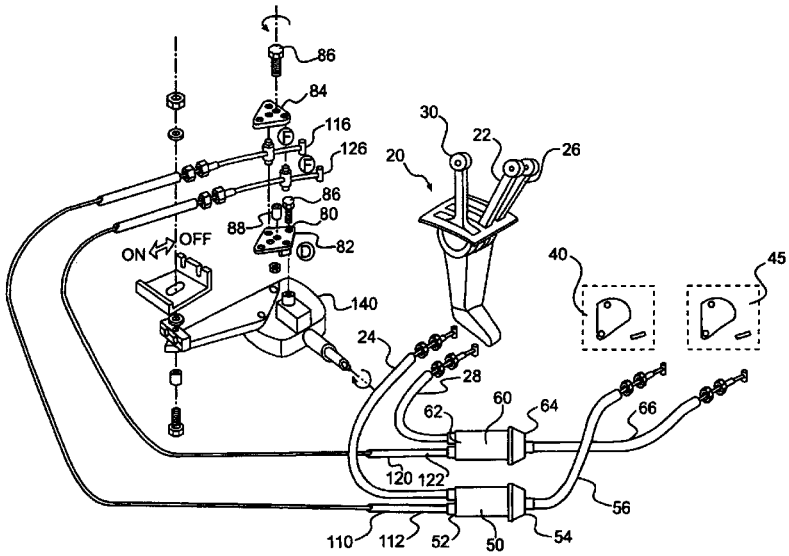

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

The patentability of claims 1–11, 13, 16, 17, 19–36, 42, 43, 45, 51 and 52 is confirmed.

Claims 14, 15, 18, 37–41, 44, 46–50 and 53 are cancelled.

Claim 12 was not reexamined.

* * * * *